US007072830B2

(12) United States Patent
Sasaki et al.

(10) Patent No.: US 7,072,830 B2
(45) Date of Patent: Jul. 4, 2006

(54) AUDIO CODER

(75) Inventors: Hitoshi Sasaki, Kawasaki (JP); Yasuji Ota, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 0 days.

(21) Appl. No.: 11/185,302

(22) Filed: Jul. 20, 2005

(65) Prior Publication Data

US 2005/0278174 A1 Dec. 15, 2005

Related U.S. Application Data

(63) Continuation of application No. PCT/JP2003/007380, filed on Jun. 10, 2003.

(51) Int. Cl.
*G10L 19/04* (2006.01)

(52) U.S. Cl. ..... 704/222; 704/500

(58) Field of Classification Search ..... 704/222, 704/500

See application file for complete search history.

(56) References Cited

U.S. PATENT DOCUMENTS 5,819,213 A * 10/1998 Oshikiri et al. ..... 704/222

6,601,032 B1 * 7/2003 Surucu ..... 704/500

FOREIGN PATENT DOCUMENTS

| | | |
|---|---|---|
| JP | 2-246625 | 10/1990 |
| JP | 10-056388 | 2/1998 |
| JP | 10-233696 | 9/1998 |
| JP | 11-220405 | 8/1999 |
| JP | 2000-347694 | 12/2000 |

* cited by examiner

*Primary Examiner*—Daniel Abebe
(74) *Attorney, Agent, or Firm*—Katten Muchin Rosenman LLP

(57) ABSTRACT

An audio coder that improves audio quality by reducing a quantization error. When a code corresponding to a sampled value of an audio signal is determined, a candidate code storage section stores all combinations of candidate codes in a neighborhood interval of the sampled value. A local decoder generates reproduced signals by decoding the codes stored in the candidate code storage section. An error evaluation section calculates, for each candidate code, a sum of squares of differentials between input sampled values and reproduced signals, detects a combination of candidate codes by which a smallest sum is obtained, that is to say, which minimizes a quantization error, and outputs a code included in the detected combination of candidate codes.

5 Claims, 19 Drawing Sheets

AUDIO CODER

This application is a continuing application, filed under 35 U.S.C. §111(a), of International Application PCT/JP2003/007380, filed on Jun. 10, 2003.

BACKGROUND OF THE INVENTION (1) Field of the Invention

This invention relates to an audio coder and, more particularly, to an audio coder for performing coding by compressing audio signal information.

(2) Description of the Related Art

Audio is digitized for using mobile communication, CDs, and the like, so digital audio signals have become familiar to users. Low bit rate coding is performed to efficiently compress and transmit digital audio signals.

The low bit rate coding is a technique for eliminating the redundancy of information and compressing the information. By adopting this technique, distortion is perceived by man' sense of hearing as little as possible and transmission capacity can be saved. Various methods are proposed. The adaptive differential pulse code modulation (ADPCM) standardized in the ITU-T Recommendation G.726 is widely used as algorithm for the low bit rate coding of audio signals.

Each of FIGS. 18 and 19 shows the structure of a block included in an ADPCM coder-decoder. An ADPCM coder 110 includes an A/D converter 111, an adaptive quantization section 112, an adaptive inverse quantization section 113, an adaptive predictor 114, a subtracter 115, and an adder 116. The components enclosed with a dotted line make up a local decoder. An ADPCM decoder 120 includes an adaptive inverse quantization section 121, an adaptive predictor 122, a D/A converter 123, and an adder 124 (the local decoder in the ADPCM coder 110 serves as a decoder).

In the ADPCM coder 110, the A/D converter 111 converts input audio into a digital signal x. The subtracter 115 finds out the differential between the current input signal x and a predicted signal y generated on the basis of a past input signal by the adaptive predictor 114 to generate a predicted residual signal r.

The adaptive quantization section 112 performs quantization by increasing or decreasing a quantization step size according to the past quantized value of the predicted residual signal r so that a quantization error will be small. That is to say, if the amplitude of the quantized value of the previous sample is smaller than or equal to a certain value, a change is considered to be small. In this case, the quantization step size is narrowed by multiplying the quantization step size by a coefficient (scaling factor) smaller than one, and quantization is performed.

If the amplitude of the quantized value of the previous sample is greater than the certain value, a change is considered to be great. In this case, the quantization step size is widened by multiplying the quantization step size by a coefficient greater than one, and coarse quantization is performed.

The number of quantization levels used by the adaptive quantization section 112 depends on the number of bits used for coding. For example, if four bits are used for coding, then the number of quantization levels is sixteen. If the frequency of sampling performed by the A/D converter 111 is 8 kHz, then the bit rate of digital output (ADPCM code) z from the adaptive quantization section 112 is 32 Kbits/s (=8 kHz×4 bits) (if the bit rate of a digital audio signal outputted from the A/D converter 111 is 64 Kbits/s, then a compression ratio of 1/2 is obtained).

The ADPCM code z is also inputted to the adaptive inverse quantization section 113 included in the local decoder. The adaptive inverse quantization section 113 inverse-quantizes the ADPCM code z to generate a predicted quantization residual signal ra. The adder 116 adds the predicted signal y and the predicted quantization residual signal ra to generate a reproduced signal (local reproduced signal) xa.

The adaptive predictor 114 includes an adaptive filter. The adaptive predictor 114 generates a predicted signal y for the next input sample value on the basis of the reproduced signal xa and the predicted quantization residual signal ra and sends it to the subtracter 115, while continuously adjusting the prediction coefficient of the adaptive filter so as to minimize the power of the predicted residual signal.

On the other hand, the ADPCM decoder 120 performs the very same process that is performed by the local decoder in the ADPCM coder 110 on the ADPCM code z transmitted to generate a reproduced signal xa. The reproduced signal xa is converted into an analog signal by the D/A converter 123 to obtain audio output.

In recent years the ADPCM has widely been used for providing various audio services. For example, ADPCM sound sources are contained in cellular phones to use animal calls or human voices sampled as incoming calls, or realistic reproduced sounds are used for adding sound effects to game music. Accordingly, further improvement in audio quality is required.

Conventionally, a technique for adaptive-quantizing a signal obtained by adding half of a unit quantization step size to or subtracting half of the unit quantization step size from the differential between input audio and a predicted value to determine a code, updating the unit quantization step size in the current step on the basis of the code, and finding out the next predicted value from the predicted value and an inverse-quantized value has been proposed as a method for improving audio quality by the ADPCM (see, Japanese Unexamined Patent Publication No. 10-233696, paragraphs [0049]–[0089] and FIG. 1).

With the loop control in the ADPCM coder 110 according to the ITU-T Recommendation G.726 shown in FIG. 18, the ADPCM code is generated on the basis of information regarding the quantization of only one current sample (that is to say, only one sample at time n). If the amplitude increases sharply at time (n+1), that is to say, if a signal $x_{n+1}$ greater than a predicted value is inputted, it is impossible to accommodate the change because a quantization step size $\Delta_{n+1}$ at time (n+1) remains small. As a result, a great quantization error occurs. This signal is reproduced as a sound disagreeable to hear (an artificial sound) and audio quality deteriorates.

In addition, with the conventional technique (Japanese Unexamined Patent Publication No. 10-233696), a table necessary for updating a unit quantization step size must be included both in a coder and in a decoder. This is not necessarily desirable from the viewpoint of practicability.

SUMMARY OF THE INVENTION

The present invention was made under the background circumstances described above. An object of the present invention is to provide an audio coder which can improve audio quality by reducing quantization errors.

In order to achieve the above object, an audio coder for coding an audio signal is provided. This audio coder comprises a candidate code storage section for storing, at the time of determining a code corresponding to a sampled value of the audio signal, a plurality of combinations of candidate codes in a neighborhood interval of the sampled value; a decoded signal generation section for generating reproduced signals by decoding the codes stored in the candidate code storage section; and an error evaluation section for calculating, for each candidate code, a sum of squares of differentials between input sampled values and reproduced signals, detecting a combination of candidate codes by which a smallest sum is obtained, that is to say, which minimizes a quantization error, and outputting a code included in the detected combination of candidate codes.

The above and other objects, features and advantages of the present invention will become apparent from the following description when taken in conjunction with the accompanying drawings which illustrate preferred embodiments of the present invention by way of example.

DESCRIPTION OF THE PREFERRED EMBODIMENTS

Figure 1:
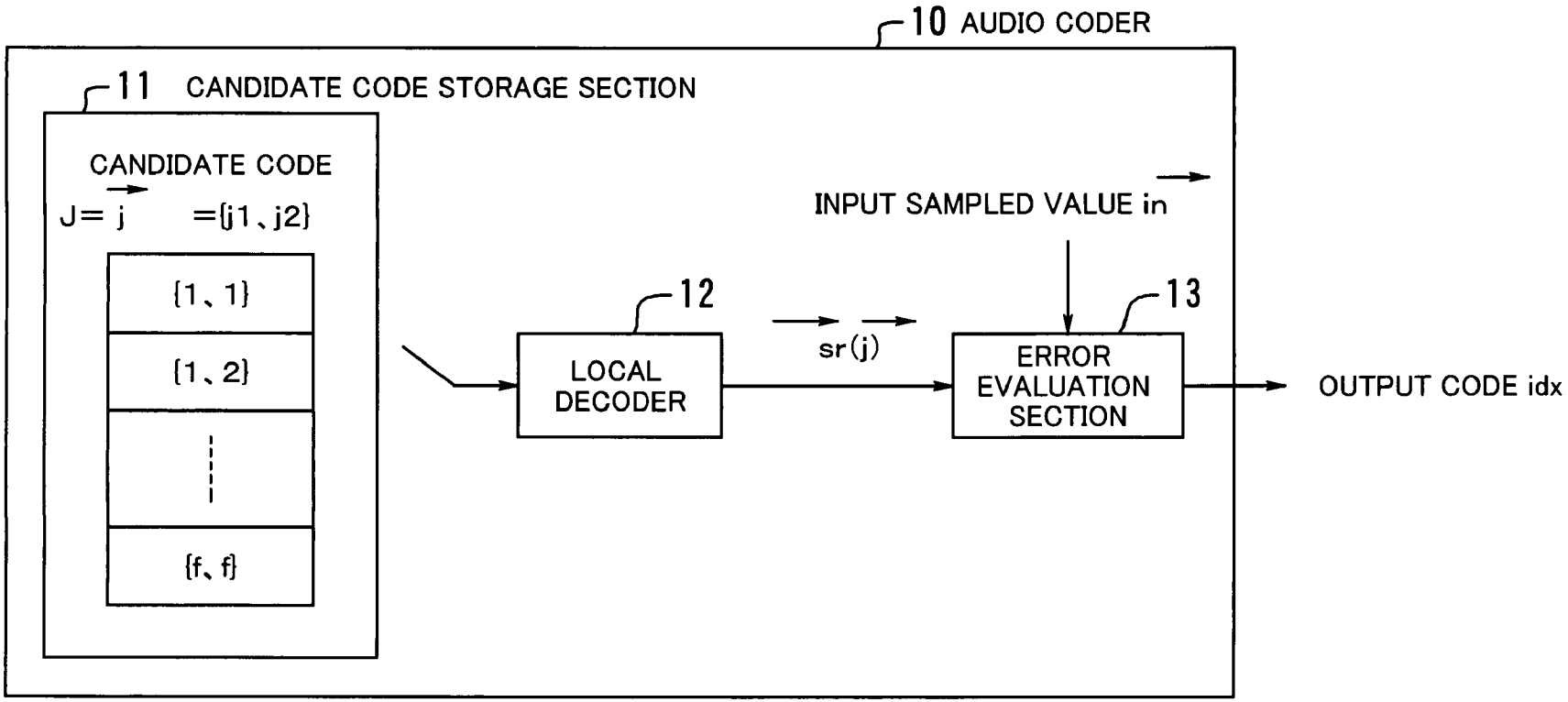
FIG. 1 is a view for describing the principles underlying an audio coder according to the present invention.

Embodiments of the present invention will now be described with reference to the drawings. FIG. 1 is a view for describing the principles underlying an audio coder according to the present invention. An audio coder 10 compresses and codes audio signal information.

When a code corresponding to a sampled value of an audio signal is determined, a candidate code storage section 11 stores a plurality (all) of combinations of candidate codes {j1, j2, . . . , j (pr+1)} at time n through time (n+k) ($0 \leqq k \leqq pr$), respectively, in a neighborhood interval including pr future samples described later. In this example, the number pr of future samples is one and a combination of a candidate code j1 at time n and a candidate code j2 at time (n+1) is stored.

A decoded signal generation section (local decoder) 12 generates reproduced signals sr by decoding in order codes stored in the candidate code storage section 11. An error evaluation section 13 calculates, for each candidate code, a sum of squares of differentials between input sampled values in of the input audio signal and reproduced signals sr, detects a combination of candidate codes by which the smallest sum is obtained (a quantization error can be considered to be smallest), and outputs a code idx included in the detected combination of candidate codes.

Vectors in FIG. 1 mean that sequential processing is performed. That is to say, the candidate code marked with a vector means that candidate codes {1, 1}, {1, 2}, . . . are inputted in order from the candidate code storage section 11 to the local decoder 12. The reproduced signal marked with a vector means that reproduced signals are generated in order by the local decoder 12 and are inputted to the error evaluation section 13. The input sampled value with a vector means that input sampled values are inputted in order to the error evaluation section 13.

It is assumed that a code idx[n] corresponding to a sampled value at time n is determined. As stated above, coding has conventionally been performed by quantizing only one sample at time n. In the present invention, however, the code idx[n] is determined by using not only a sample at time n but also information in a sampling interval (neighborhood interval) including time n as objects of error evaluation.

That is to say, not only the present sampled value but also future samples are used. If the number of future samples is, for example, one, then the code idx[n] at time n is determined by taking two samples obtained at time n and time (n+1), respectively, into consideration.

If the number of future samples is two, then the code idx[n] at time n is determined by taking three samples obtained at time n, time (n+1), and time (n+2), respectively, into consideration. The detailed operation of the audio coder 10 will be described in FIG. 4 and the later ones.

Figure 2:
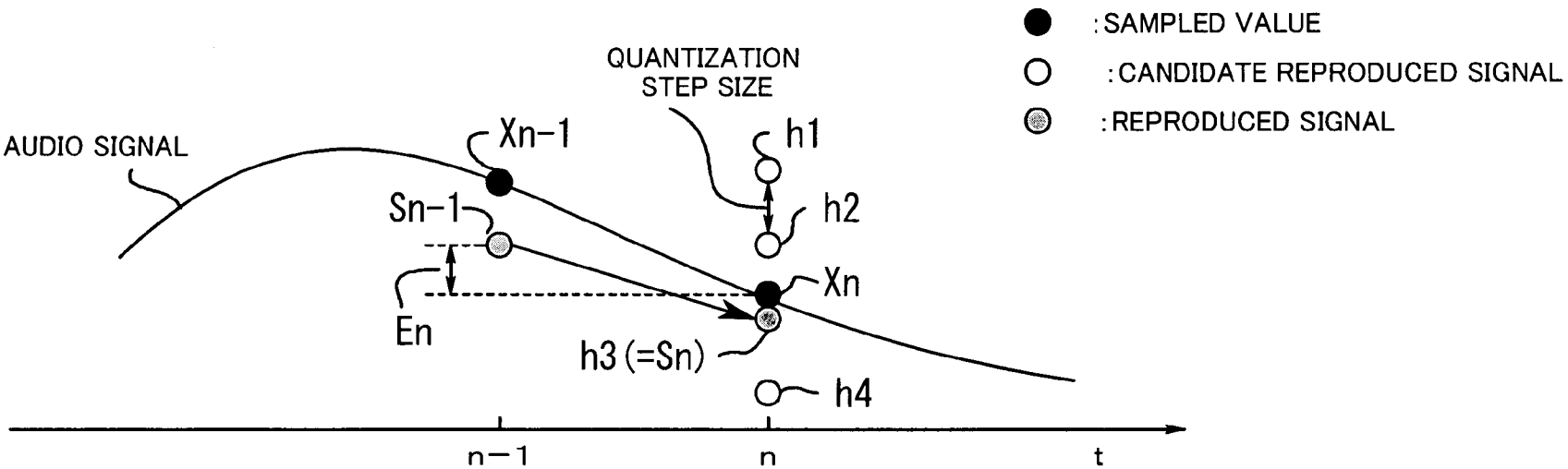
FIG. 2 shows how to find out a reproduced signal.

Problems to be solved by the present invention will now be described in detail with reference to FIGS. 2 and 3. FIG. 2 shows how to find out a reproduced signal. For the sake of simplicity, it is assumed that prediction is not performed (the differential between an input sample and a reproduced signal is merely quantized) and that each sample is quantized by using two bits (the number of quantization levels is four).

It is assumed that sampled values of an audio signal obtained at time (n−1) and time n are Xn−1 and Xn, respectively, and that a reproduced signal decoded at time (n−1) is Sn−1.

In order to find out the reproduced signal at time n, the differential between the sampled value Xn at time n and the reproduced signal Sn−1 at time (n−1) is calculated first to generate a differential signal En. (If a prediction process is performed, then the differential at the same time is calculated. In this example, however, prediction is not performed, so the differential between the preceding reproduced signal and the current input sampled value is calculated.)

The differential signal En is quantized and a quantized value at time n is selected. In this example, quantization is performed by using two bits, so there are four candidate quantized values (h1 through h4). A quantized value that can express the differential signal En most correctly (that is the closest to the sampled value Xn) will be selected from among these four candidate quantized values (an interval between adjacent dots corresponds to a quantization step size).

In FIG. 2, the quantized value h3 can express the differential signal En most correctly (that is to say, the dot h3 is the closest to the sampled value Xn). Therefore, the quantized value h3 is selected as the reproduced signal (Sn) at time n and an ADPCM code indicative of the quantized value h3 will be outputted from the coder.

Figure 3:
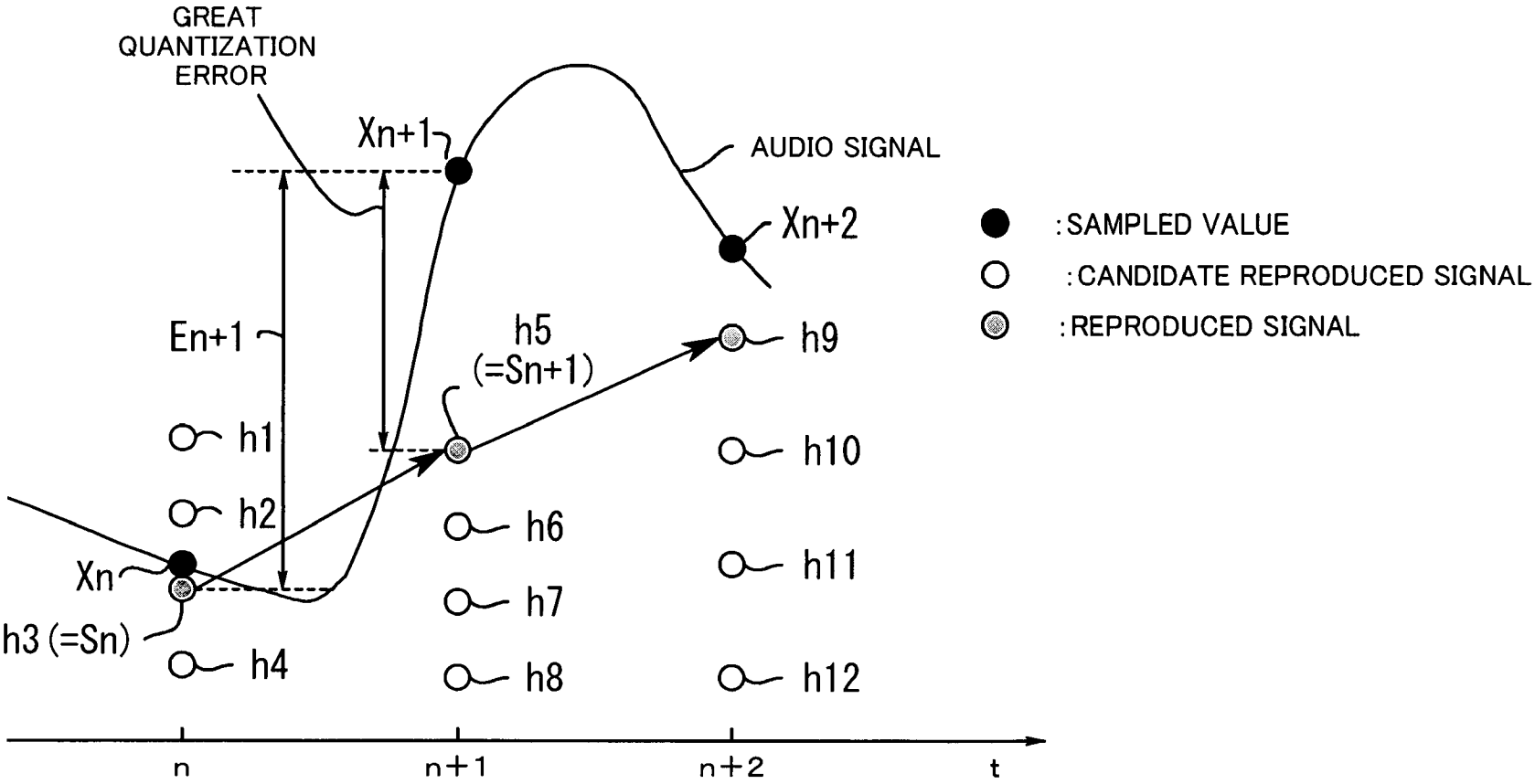
FIG. 3 shows how a great quantization error occurs because of being incapable of accommodating a change in amplitude.

FIG. 3 shows how a great quantization error occurs because of being incapable of accommodating a change in amplitude. FIG. 3 indicates a problem with a conventional ADPCM coder. It is assumed that sampled values at time (n+1) and time (n+2) of the audio signal shown in FIG. 2 are Xn+1 and Xn+2, respectively, and that a reproduced signal decoded at time n is Sn shown in FIG. 2. In addition, it is assumed that the waveform of the audio signal increases rapidly in amplitude at about time (n+1).

In this example, a reproduced signal at time (n+1) is found out. The differential between the sampled value Xn+1 at time (n+1) and the reproduced signal Sn at time n is calculated first to generate a differential signal En+1.

The differential signal En+1 is then quantized and a quantized value at time (n+1) is selected. In this example, quantization is performed by using two bits, so there are four candidate quantized values (h5 through h8). A quantization step size for these quantized values depends on a quantized value selected just before.

In other words, if one of the two inside dots of the four dots (quantized values) was selected at time n, then a change in amplitude is small when time changes from (n−1) to n. Therefore, a change in amplitude which will occur when time changes from n to (n+1) is considered to be small and a quantization step size at time (n+1) is made small.

If one of the two outside dots of the four dots (quantized values) was selected at time n, then a change in amplitude is great when time changes from (n−1) to n. Therefore, a change in amplitude which will occur when time changes from n to (n+1) is considered to be great and a quantization step size at time (n+1) is made great.

In this example, h3 (one of the two inside dots) is selected from among the candidate reproduced signals h1 through h4 as the reproduced signal Sn at time n. Accordingly, a change in amplitude can be considered to be small and a quantization step size (that is to say, an interval between adjacent dots of the dots h5 through h8) at time (n+1) is made small (a scaling factor smaller than one used at time n is also used at time (n+1) and the dot interval is the same as that of the dots h1 through h4).

After that, a quantized value that can express the differential signal En+1 most correctly will be selected from among the candidate quantized values h5 through h8. However, the amplitude of the audio signal rapidly increases at time (n+1). Therefore, when a reproduced signal that can express the differential signal En+1 most correctly (a dot that is the closest to the sampled value Xn+1) is selected from among the candidate reproduced signals h5 through h8 for which a quantization step size is not great, the best way is to select h5.

The quantized value h5 is selected in this way as a reproduced signal (Sn+1) at time (n+1) and an ADPCM code indicative of the quantized value h5 is outputted from the coder. As can be seen from FIG. 3, however, a great quantization error occurs, resulting in deterioration in audio quality.

The reproduced signal Sn+1 at time (n+1) is obtained by selecting h5 (one of the two outside dots) from among the candidate reproduced signals h5 through h8. Accordingly, a change in amplitude is considered to be great, and a quantization step size (that is to say, an interval between adjacent dots of the dots h9 through h12) for quantized values at time (n+2) is greater than that at time (n+1). The same process that is described above is performed to select h9 as a reproduced signal.

With the conventional ADPCM, as stated above, even when an audio level changes rapidly, the quantized value of a sample the amplitude of which significantly changes is found out on the basis of a quantization step size which was applied when a change in the audio level was small. As a result, a great quantization error occurs and audio quality deteriorates. In the present invention, even when the amplitude of audio changes significantly, audio quality is improved by efficiently reducing a quantization error.

Figure 4:
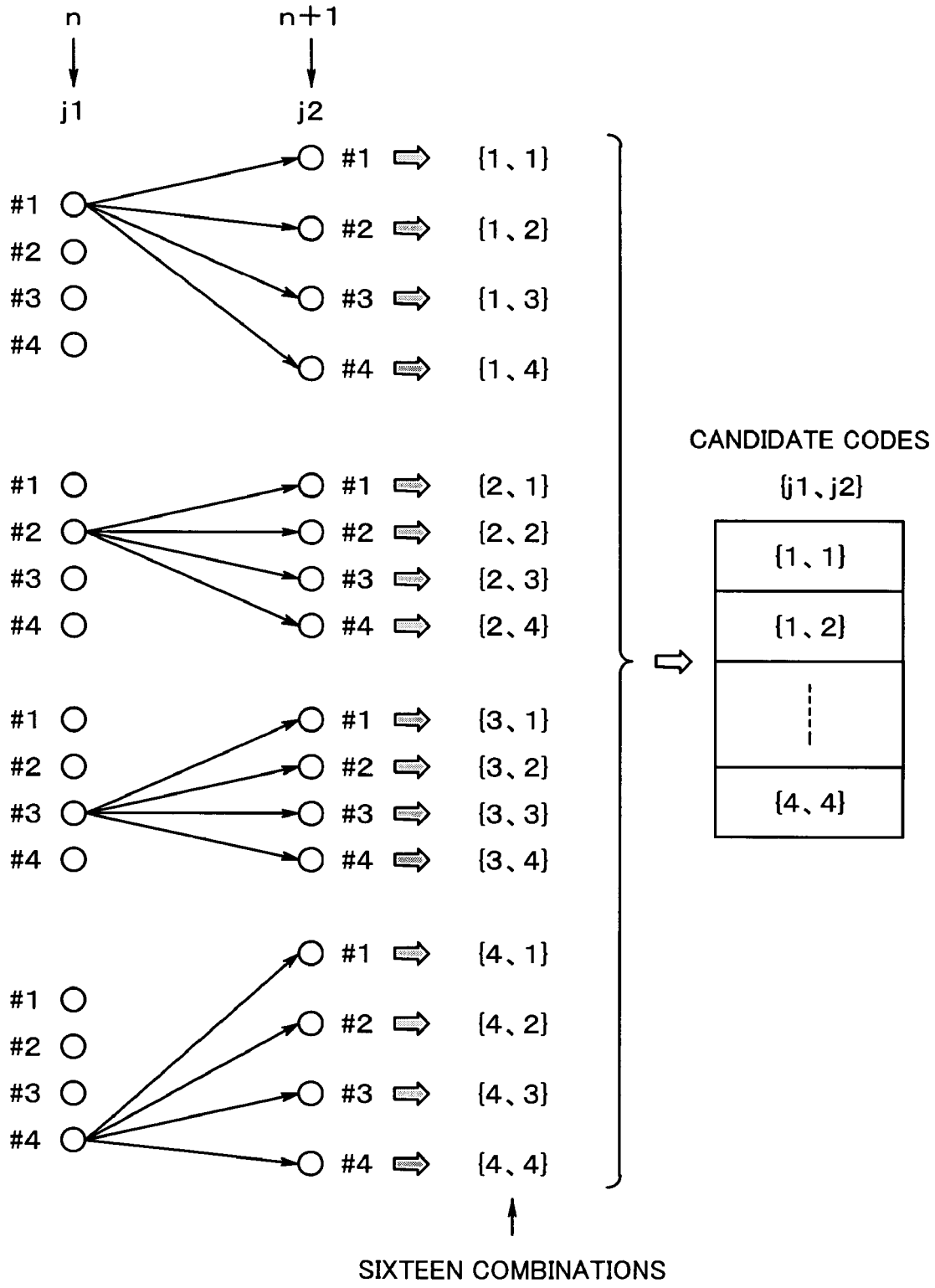
FIG. 4 is a view for describing the concept of candidate codes stored in a candidate code storage section.

The structure and operation of the audio coder 10 according to the present invention will now be described in detail. The candidate code storage section 11 will be described first. FIG. 4 is a view for describing the concept of candidate codes stored in the candidate code storage section 11. It is assumed that a code idx[n] corresponding to a sampled value at time n of an audio signal is determined. Moreover, it is assumed that a sampled value at time (n+1) is included in a neighborhood interval of the sampled value at time n (that is to say, the number of future samples is one) and that each sample is quantized by using two bits.

There are four candidates #1 through #4 for a code j1 indicative of a quantized value corresponding to the sampled value at time n. There are also four candidates #1 through #4 for a code j2 at time (n+1) for each of the candidates #1 through #4 for the code j1.

The case where #1 is selected as the code j1 indicative of a quantized value corresponding to the sampled value at time n and where #1 is selected as the code j2 at time (n+1) can be represented as, for example, {1, 1}. There are sixteen combinations of candidate codes: {1, 1}, {1, 2}, . . . , {4, 3}, and {4, 4}.

To determine a code at time n by performing quantization by the use of two bits, the sampled value at time (n+1) is also used (that is to say, the number of future samples is one). Then the candidate code storage section 11 stores all of the sixteen combinations of the code j1 at time n and the code j2 at time (n+1): {1, 1}, {1, 2}, . . . , {4, 3}, and {4, 4}.

In addition, the candidate code storage section 11 inputs these candidate codes in order into the local decoder 12. After all of the sixteen combinations are inputted, a code at time (n+1) is determined in the audio coder 10. Accordingly, a sampled value at time (n+2) is used and the candidate code storage section 11 stores all of sixteen combinations of a code j1 at time (n+1) and a code j2 at time (n+2). The candidate code storage section 11 inputs these candidate codes again into the local decoder 12. Afterwards, this operation will be repeated.

In the above example, when a code idx[n] at time n is determined, it is assumed that the number of future samples is one, that is to say, the sampled value at time (n+1) is also used. If quantization is performed by using two bits and the number of future samples is two, then the candidate code storage section 11 stores all of sixty-four combinations of a code j1 at time n, a code j2 at time (n+1), and a code j3 at time (n+2): {1, 1, 1}, . . . , and {4, 4, 4} (if the number of future samples is greater than two, a process is performed in the same way).

Operation in the present invention for reducing a quantization error at encoding time will now be described with reference to FIGS. 5 through 11. It is assumed that a code idx[n] at time n is determined and that the number of future samples is one (that is to say, information at time (n+1) is used). For the sake of simplicity, prediction is not performed and quantization is performed by using two bits.

FIGS. 5 through 10 are views for describing operation in the present invention. It is assumed that sampled values at time n and time (n+1) of an audio signal are Xn and Xn+1, respectively, and that the waveform of the audio signal increases sharply in amplitude at about time (n+1).

Figure 5:
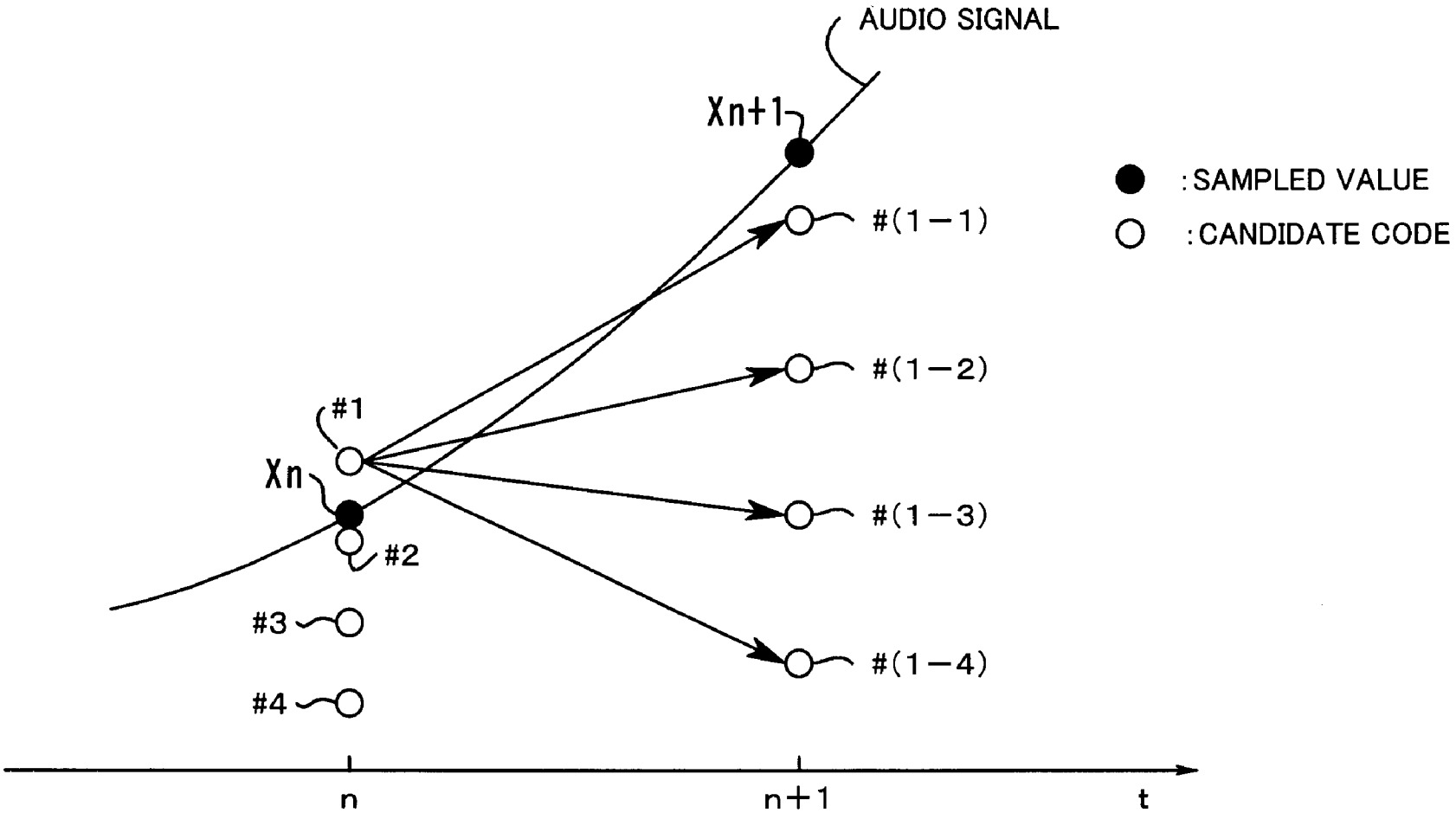
FIG. 5 is a view for describing operation in the present invention.

In FIG. 5, when a candidate code j1 at time n is decoded, there are four candidate codes #1 through #4. It is assumed that the candidate code #1 is selected first at time n. Then a candidate code which corresponds to the candidate code #1 can be selected at time (n+1) from among four candidate codes #(1-1) through #(1-4) for which a quantization step size is wide.

Figure 6:
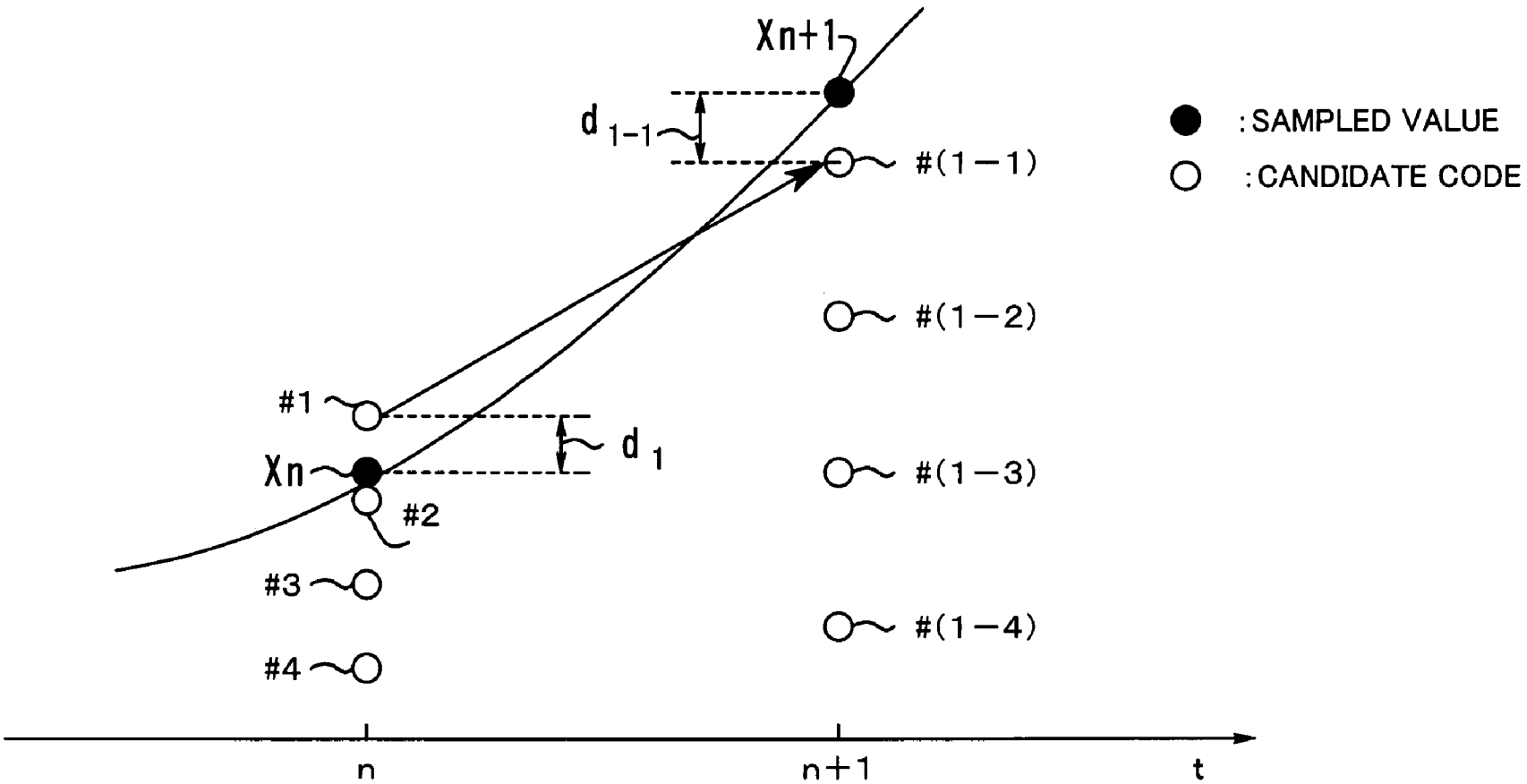
FIG. 6 is a view for describing operation in the present invention.

In FIG. 6, it is assumed that #(1-1) is selected as a candidate code at time (n+1). In this case, the differential $d_1$ between the sampled value Xn at time n and the candidate code #1 and the differential $d_{1-1}$ between the sampled value Xn+1 at time (n+1) and the candidate code #(1-1) are calculated. The sum of the square of the differential $d_1$ and the square of the differential $d_{1-1}$ is calculated to find out an error evaluation value e({1, 1}).

$$e(\{1, 1\})=(d_1)^2+(d_{1-1})^2 \quad (1)$$

Figure 7:
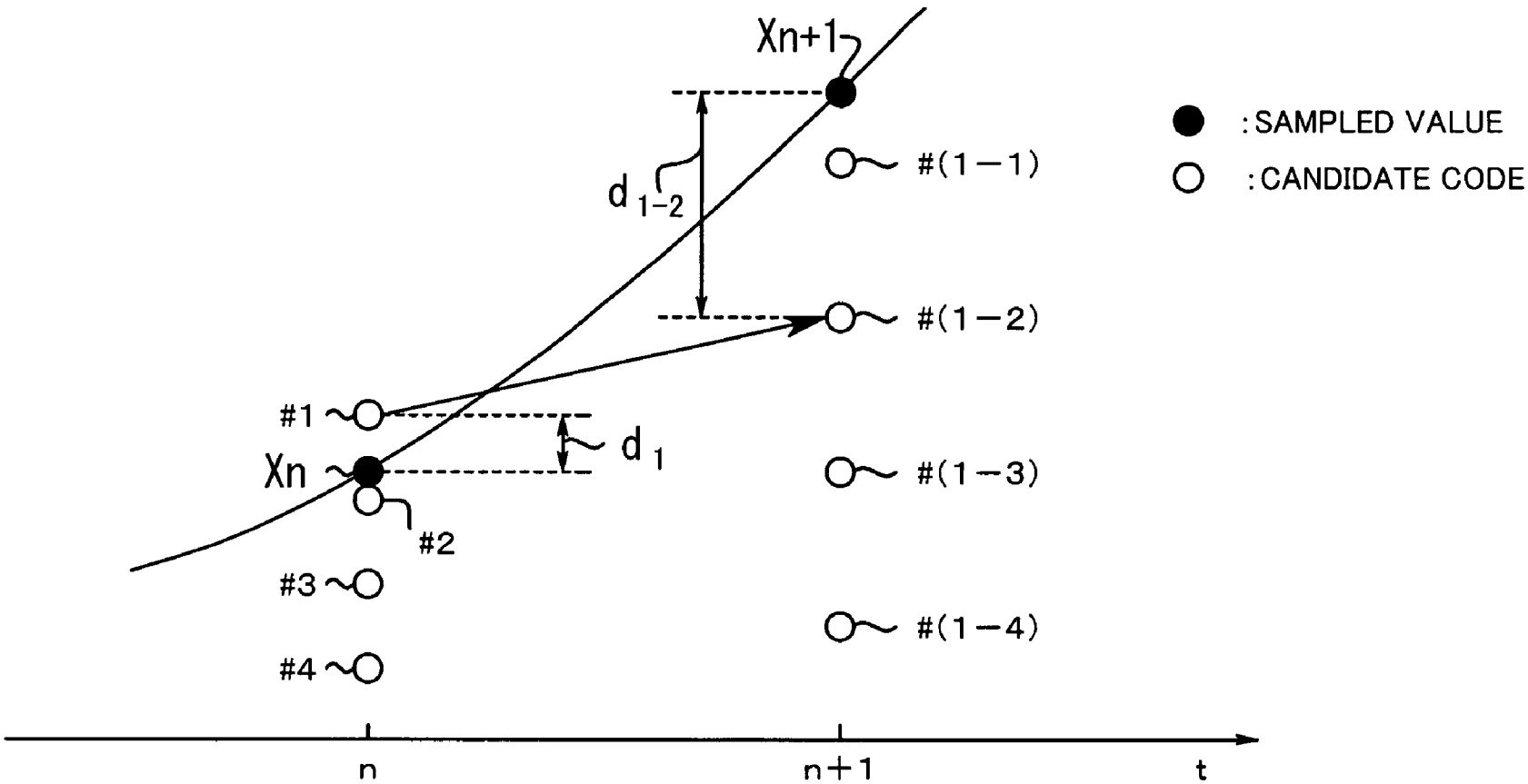
FIG. 7 is a view for describing operation in the present invention.

In FIG. 7, it is assumed that #(1-2) is selected as a candidate code at time (n+1). In this case, the differential between the sampled value Xn at time n and the candidate code #1 is $d_1$. The differential $d_{1-2}$ between the sampled value Xn+1 at time (n+1) and the candidate code #(1-2) is calculated. The sum of the square of the differential $d_1$ and the square of the differential $d_{1-2}$ is calculated to find out an error evaluation value e({1, 2}).

$$e(\{1, 2\})=(d_1)^2+(d_{1-2})^2 \quad (2)$$

If #(1-3) or #(1-4) is selected as a candidate code at time (n+1), the same process is performed to find out an error evaluation value e({1, 3}) or e({1, 4}).

Figure 8:
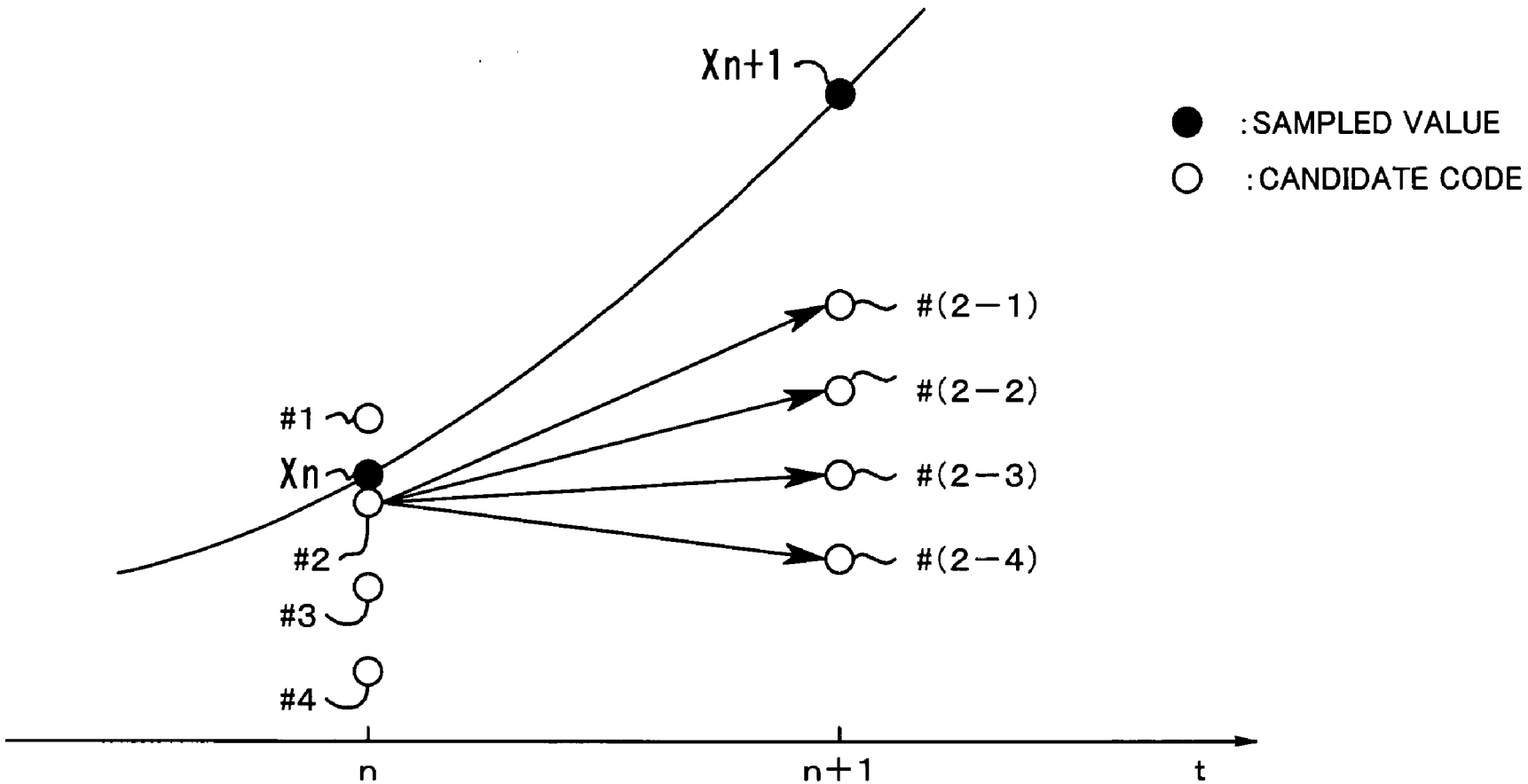
FIG. 8 is a view for describing operation in the present invention.

In FIG. 8, It is assumed that the candidate code #2 is selected at time n. Then a candidate code which corresponds to the candidate code #2 can be selected at time (n+1) from among four candidate codes #(2-1) through #(2-4) for which a quantization step size is narrow.

Figure 9:
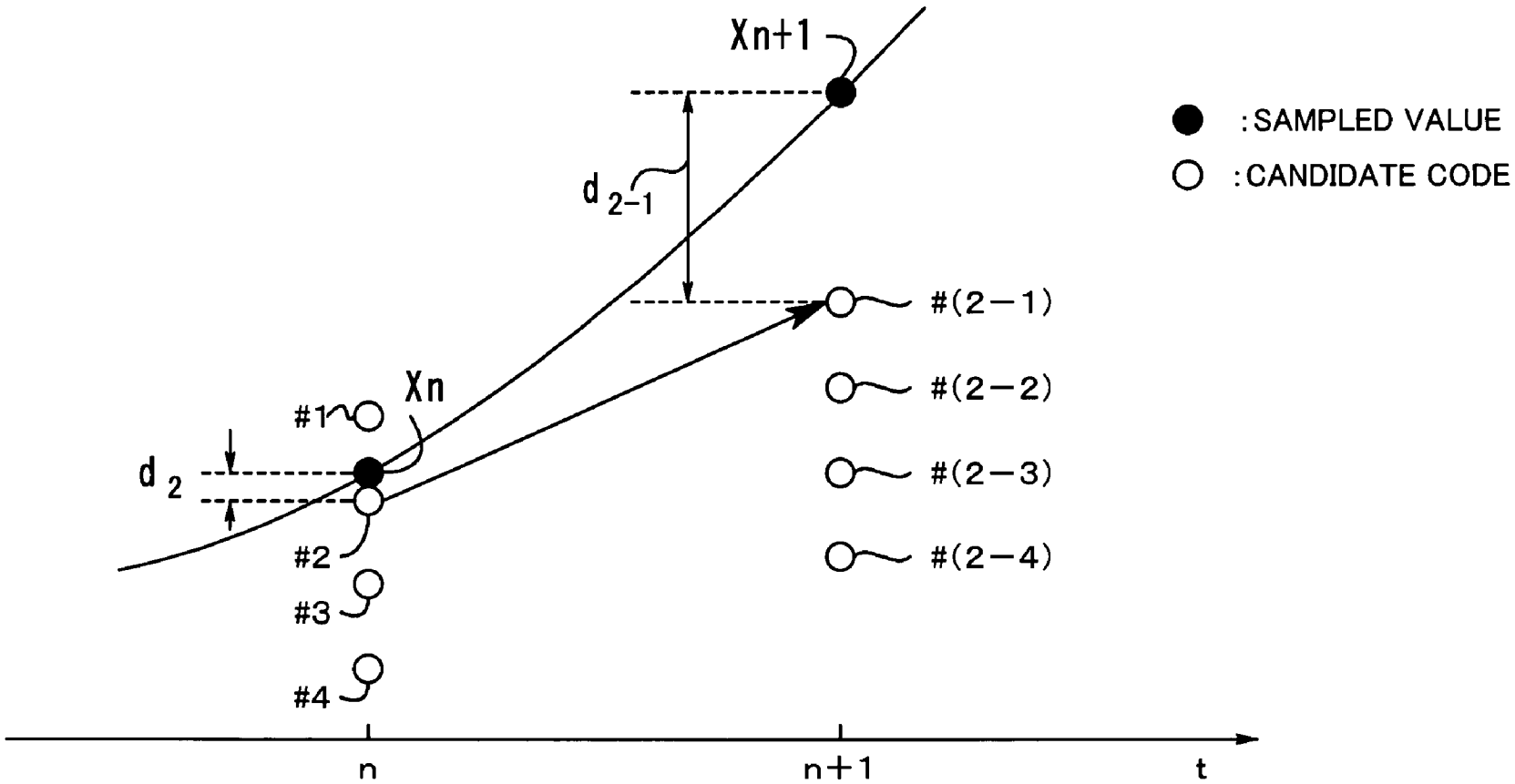
FIG. 9 is a view for describing operation in the present invention.

In FIG. 9, it is assumed that #(2-1) is selected as a candidate code at time (n+1). In this case, the differential $d_2$ between the sampled value Xn at time n and the candidate code #2 and the differential $d_{2-1}$ between the sampled value Xn+1 at time (n+1) and the candidate code #(2-1) are calculated. The sum of the square of the differential $d_2$ and the square of the differential $d_{2-1}$ is calculated to find out an error evaluation value e({2, 1}).

$$e(\{2, 1\})=(d_2)^2+(d_{2-1})^2 \quad (3)$$

Figure 10:
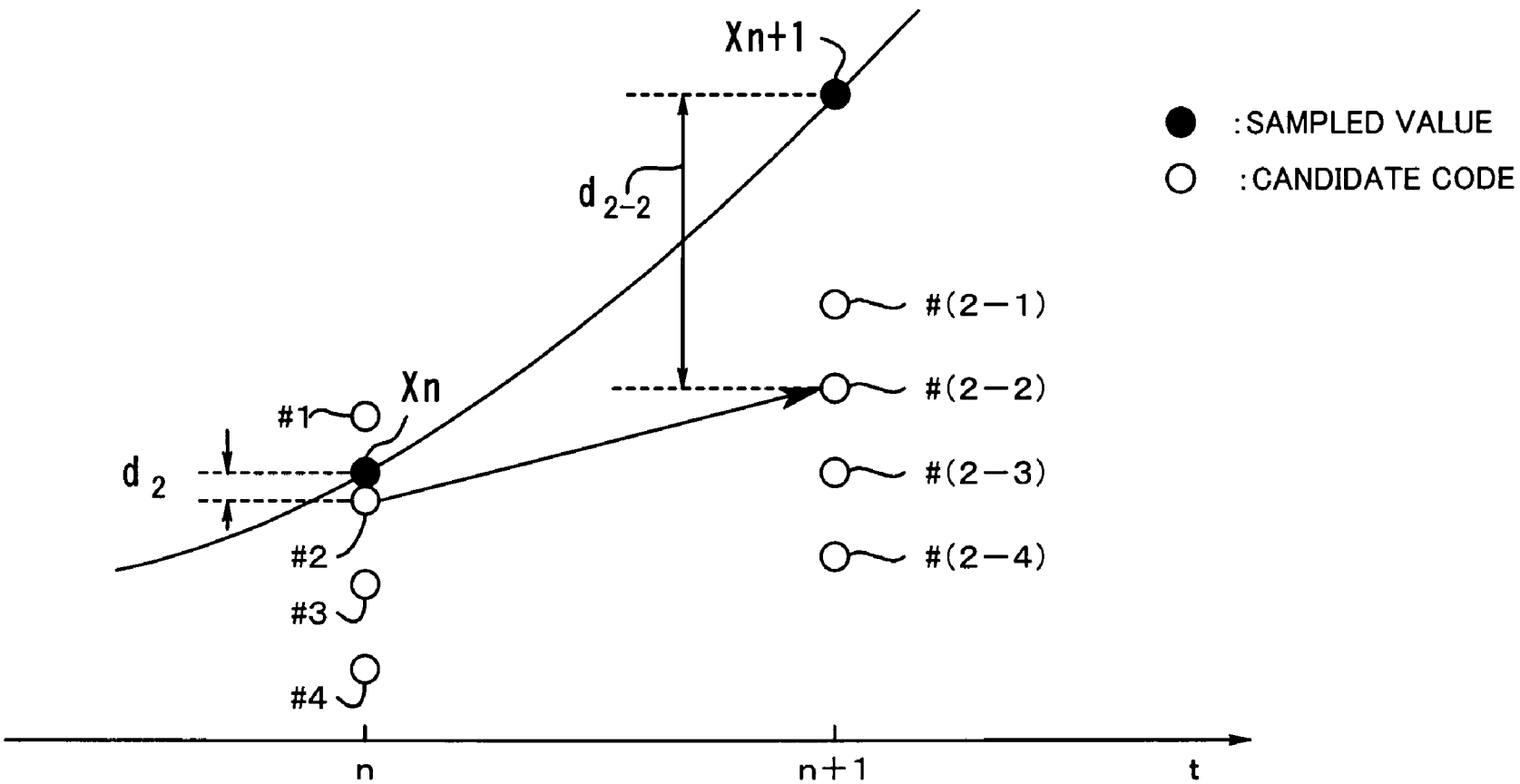
FIG. 10 is a view for describing operation in the present invention.

In FIG. 10, it is assumed that #(2-2) is selected as a candidate code at time (n+1). In this case, the differential between the sampled value Xn at time n and the candidate code #2 is $d_2$. The differential $d_{2-2}$ between the sampled value Xn+1 at time (n+1) and the candidate code #(2-2) is calculated. The sum of the square of the differential $d_2$ and the square of the differential $d_{2-2}$ is calculated to find out an error evaluation value e({2, 2}).

$$e(\{2, 2\})=(d_2)^2+(d_{2-2})^2 \quad (4)$$

If #(2-3) or #(2-4) is selected as a candidate code at time (n+1), the same process is performed to find out an error evaluation value e({2, 3}) or e({2, 4}).

The same process is performed if the candidate code #3 or #4 is selected at time n. As a result, sixteen error evaluation values e({1, 1}) through e({4, 4}) are found out. The minimum value is selected from among the sixteen error evaluation values e({1, 1}) through e({4, 4}). In this example, as can be seen from FIGS. 5 through 10, the error evaluation values e({1, 1}) shown in FIG. 6 is the smallest. Therefore, the candidate code #1 at time n is finally selected and a code idx[n] indicative of the candidate code #1 is outputted onto a transmission line.

Figure 11:
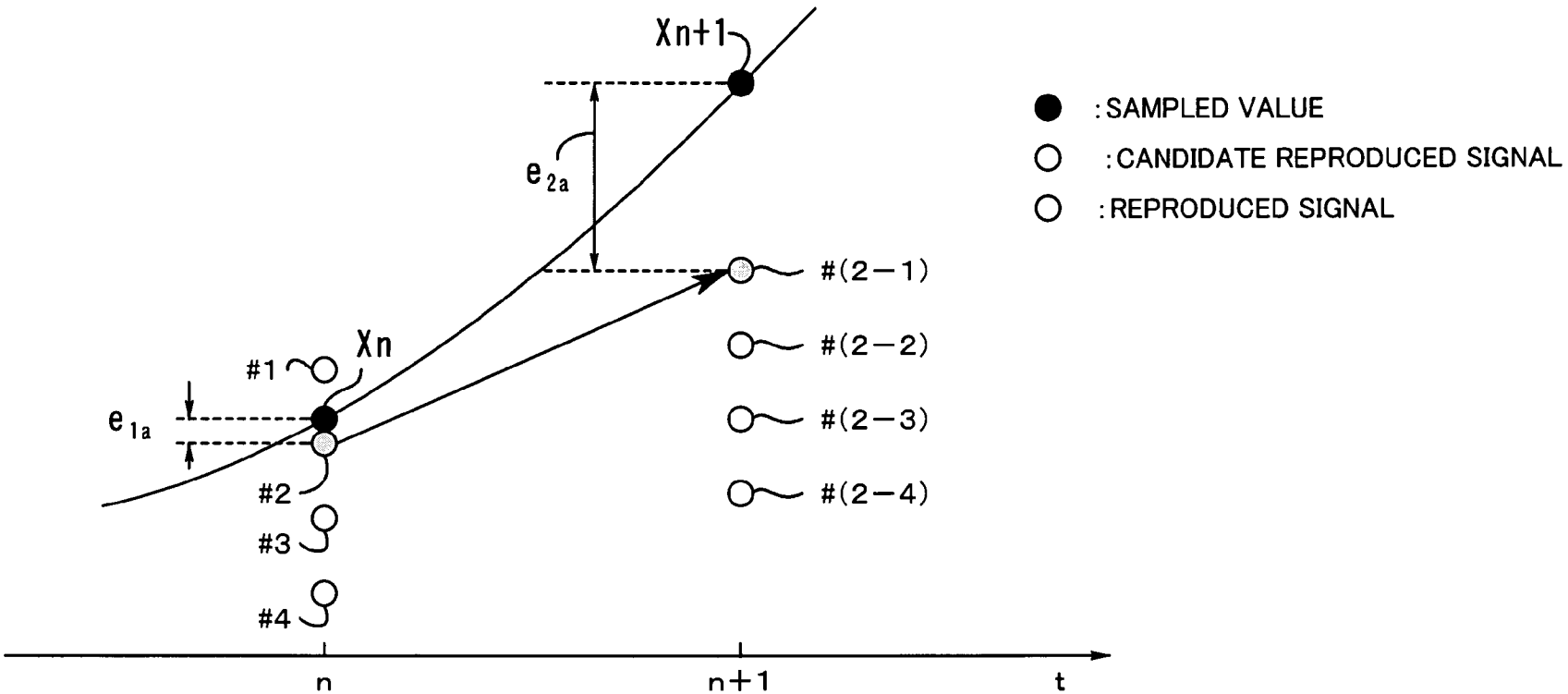
FIG. 11 shows code selection performed where the present invention is not applied.

A feature of the present invention will now be described by comparing the present invention and the conventional technique. FIG. 11 shows code selection performed where the present invention is not applied. If the process described in the example shown in FIGS. 5 through 10 is not performed and a process like that shown in FIG. 3 is performed by using the conventional technique, then the candidate code #2 that is the closest to the sampled value Xn is selected at time n and the candidate code #(2-1) that is the closest to the sampled value Xn+1 is selected at time (n+1). In this case, a quantization error $e_{1a}$ at time n is small, but a quantization error $e_{2a}$ at time (n+1) is great.

With the conventional technique, a quantization step size is determined by a value selected just before. This is the same with the present invention. With the conventional technique, however, the next quantization step size is determined on the basis of a code determined in the past. Accordingly, at time n it may be possible to determine a code that is the closest to a sampled value at time n. However, if a change in the amplitude of audio sharply becomes great at the next sampling time (n+1), a code at time (n+1) is determined on the basis of a quantization step size which was applied when a change in the amplitude of the audio was small. As a result, a great quantization error $e_{2a}$ occurs at time (n+1).

In the present invention, on the other hand, quantization errors which occur for all of the candidate codes in a neighborhood sampling interval are found out in advance and a combination of candidate codes which minimizes a quantization error is selected. Therefore, even when a change in the amplitude of the audio sharply becomes great, a code by which a great quantization error occurs at only one sampling point is not selected if the change in the amplitude is in the neighborhood sampling interval. The present invention differs from the conventional technique in this respect.

For example, FIG. 6 shows the candidate codes #1 and #(1-1) which minimize an error evaluation value. The candidate code #1 is selected at time n. Accordingly, compared with the case of FIG. 11 where the conventional technique is used, a quantization error $e_1$ ($=d_1$) at time n is great ($e_1>e_{1a}$).

By selecting the candidate code #1 at time n, however, a quantization step size can be widened at time (n+1). In this case, at time (n+1) a candidate code that is the closest to the sampled value Xn+1 is selected from among the candidate codes #(1-1) and #(1-4) for which a quantization step size is wide. As a result, $(e_1+e_2(=d_{1-1}))<(e_{1a}+e_{2a})$. This means that the present invention can reduce a quantization error compared with the conventional technique.

With the conventional technique, as stated above, a quantization error can be made small before the great change in the amplitude of the audio, but a great quantization error occurs after the great change in the amplitude of the audio. In the present invention, on the other hand, the whole of quantization errors which occur before and after the great change in the amplitude of the audio is made small. As a result, an S/N ratio can be improved.

Figure 12:
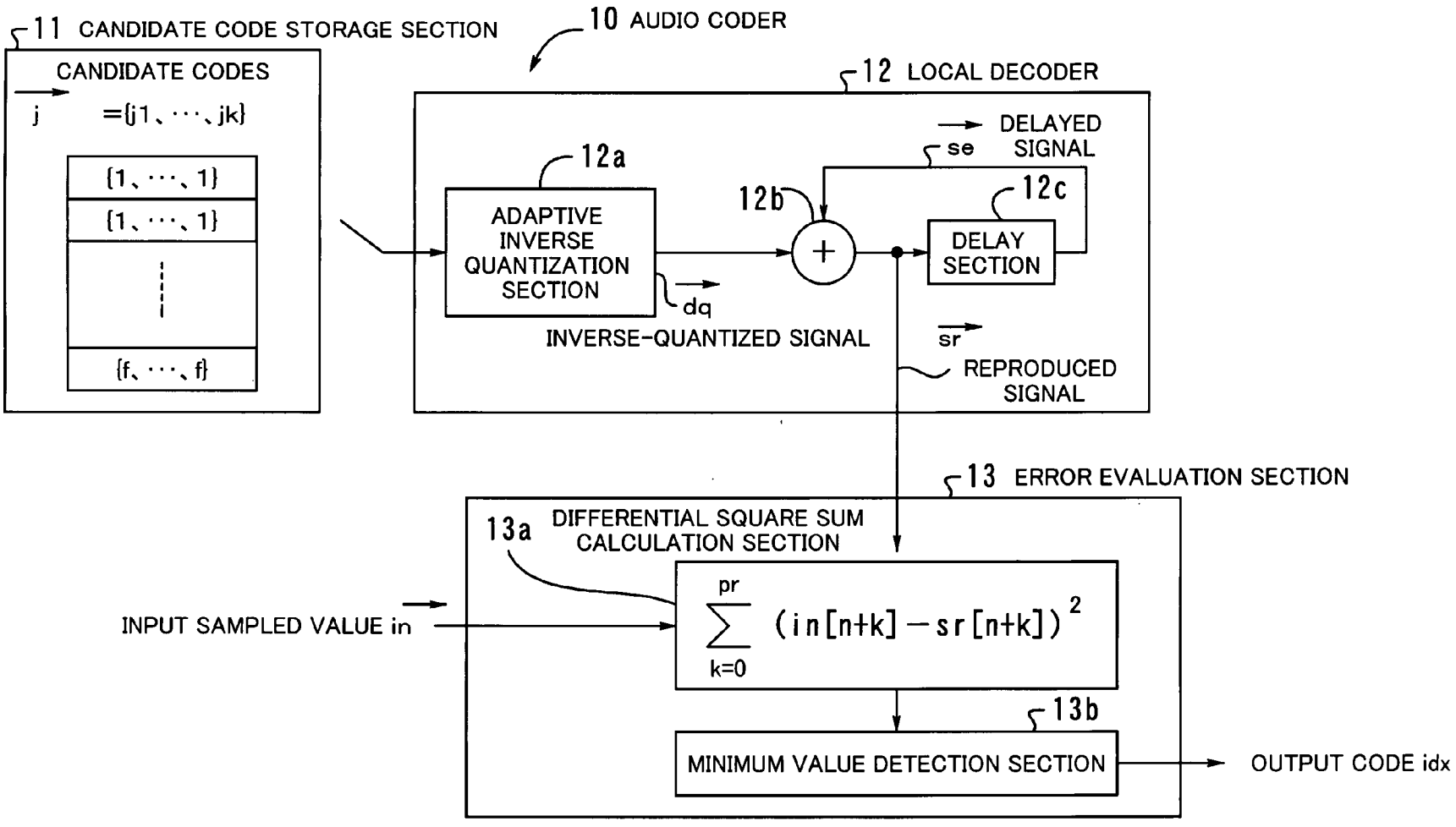
FIG. 12 shows the structure of the audio coder.

A detailed block diagram of the local decoder 12 and the error evaluation section 13 included in the audio coder 10 will now be described. FIG. 12 shows the structure of the audio coder 10. The audio coder 10 comprises the candidate code storage section 11, the local decoder 12, and the error evaluation section 13. The local decoder 12 includes an adaptive inverse quantization section 12*a*, an adder 12*b*, and a delay section 12*c*. The error evaluation section 13 includes a differential square sum calculation section 13*a* and a minimum value detection section 13*b*. The candidate code storage section 11 has been described before, so the local decoder 12 and the error evaluation section 13 will now be described. It is assumed that the candidate code storage section 11 stores combinations of a code j1 at time n and a code j2 at time (n+1).

In the local decoder 12, when the adaptive inverse quantization section 12*a* receives the candidate code {1, 1}, the adaptive inverse quantization section 12*a* updates a quantization step size on the basis of a processing result at time (n−1). The adaptive inverse quantization section 12*a* recognizes a quantized value corresponding to the code j1=#1 at time n, inverse-quantizes the quantized value, and outputs an inverse-quantized signal dq[n].

The adder 12*b* adds a delayed signal se[n] (which is obtained by delaying by one sampling time in a process at time (n−1)) outputted from the delay section 12*c* and the inverse-quantized signal dq[n], generates a reproduced signal sr[n] (=dq[n]+se[n]), and outputs it to the delay section 12*c* and the error evaluation section 13. When the delay section 12*c* receives the reproduced signal sr[n], the delay section 12*c* generates a delayed signal se[n+1] by delaying by one sampling time, and feeds back it to the adder 12*b*.

Next, the adaptive inverse quantization section 12*a* recognizes a quantized value corresponding to the code j2=#1 at time (n+1), inverse-quantizes the quantized value, and outputs an inverse-quantized signal dq[n+1]. Each of the adder 12*b* and the delay section 12*c* performs the same process that is described above. As a result, a reproduced signal corresponding to the code j2 is generated.

In the error evaluation section 13, the differential square sum calculation section 13*a* receives an input sampled value in[n] and the reproduced signal sr[n] and calculates the sum of the squares of the differentials between them by $$e(J) = \sum_{k=0}^{pr} (in[n+k] - sr[n+k])^2 \tag{5}$$

where 0≦k≦pr (pr is the number of future samples).

The minimum value detection section 13*b* detects a minimum value from among values obtained by doing calculations for all of the combinations of candidate codes by the use of expression (5). In addition, the minimum value detection section 13*b* recognizes a candidate code (reproduced signal) at time n included in a combination of candidate codes by which the minimum value is obtained, and outputs a code idx[n] corresponding to the candidate code onto a transmission line.

If prediction is performed, then the delay section 12*c* is replaced with an adaptive predictor and a reproduced signal and an inverse-quantized signal are inputted to the adaptive predictor. By doing so, an adaptive prediction method can be adopted.

Figure 13:
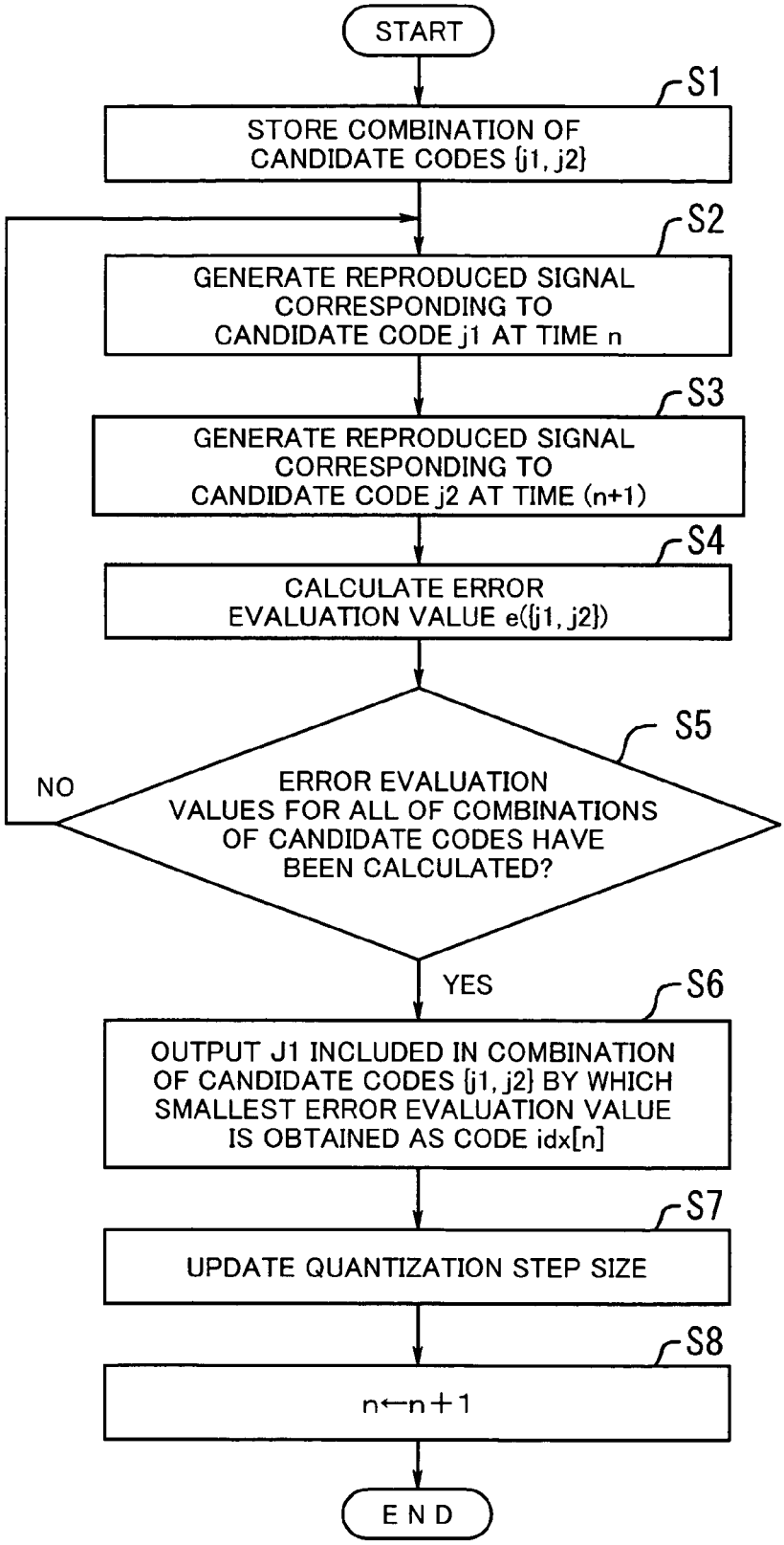
FIG. 13 is a flow chart for giving an overview of the operation of the audio coder.

FIG. 13 is a flow chart for giving an overview of the operation of the audio coder 10. It is assumed that a combination of candidate codes is expressed as {j1, j2}. j1 is a candidate code at time n and j2 is a candidate code at time (n+1).

[Step S1] The candidate code storage section 11 stores the combination of candidate codes {j1, j2}.

[Step S2] The local decoder 12 generates a reproduced signal corresponding to the candidate code j1 at time n.

[Step S3] The local decoder 12 generates a reproduced signal corresponding to the candidate code j2 at time (n+1).

[Step S4] The error evaluation section 13 calculates an error evaluation value e({j1, j2}) by the use of expression (5).

[Step S5] If error evaluation values for all of the combinations of candidate codes ({1, 1}, . . . , {f, f}) have been calculated, then step S6 is performed. If error evaluation values for all of the combinations of candidate codes ({1, 1}, . . . , {f, f}) have not been calculated, then step S2 is performed.

[Step S6] The error evaluation section 13 detects the smallest error evaluation value e({j1, j2}) and outputs j1 included in a combination of candidate codes {j1, j2} by which the smallest error evaluation value is obtained as a code idx [n] at time n.

[Step S7] The local decoder 12 updates a quantization step size at time (n+1) on the basis of j1 at time n determined in step S6.

[Step S8] Time n is updated and the process of determining a code at time (n+1) is begun (a combination of a candidate code j1 at time (n+1) and a candidate code J2 at time (n+2) is stored in the candidate code storage section 11).

In the present invention, as stated above, when a code corresponding to a sampled value of an audio signal is determined, all of the combinations of candidate codes in a neighborhood interval of the sampled value are stored, reproduced signals are generated from the candidate codes, the sum of the squares of the differentials between input sampled values and the reproduced signals is calculated, and a code included in a combination of candidate codes by which the smallest sum is obtained is outputted. As a result, even if a change in the amplitude of the audio is great, a quantization error can efficiently be reduced and audio quality can be improved. Moreover, the present invention can be realized only by changing the structure of a coder, so the present invention can easily be put to practical use.

Figure 14:
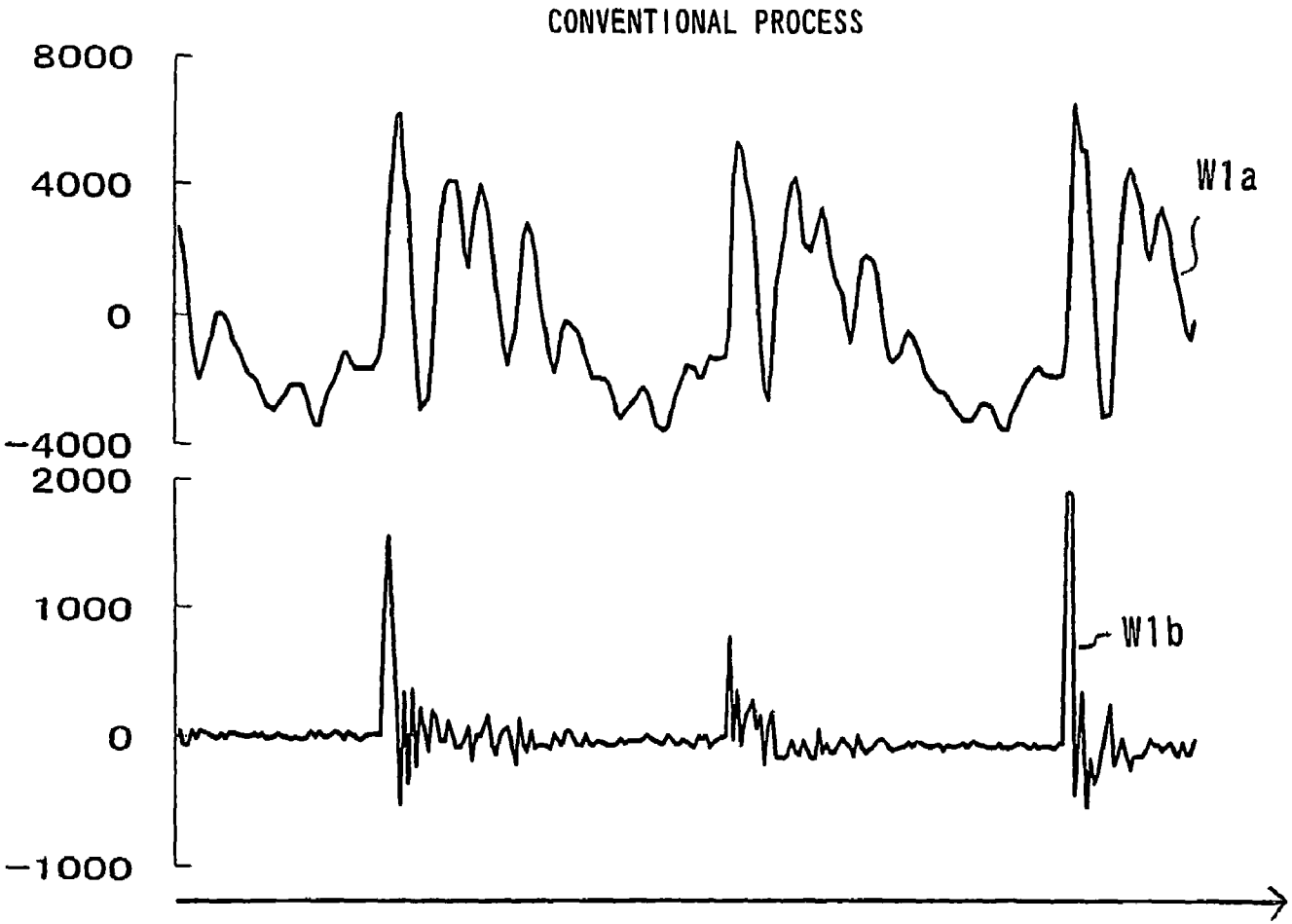
FIG. 14 PRIOR ART
FIG. 14 shows waveforms obtained by performing the conventional process.
Figure 15:
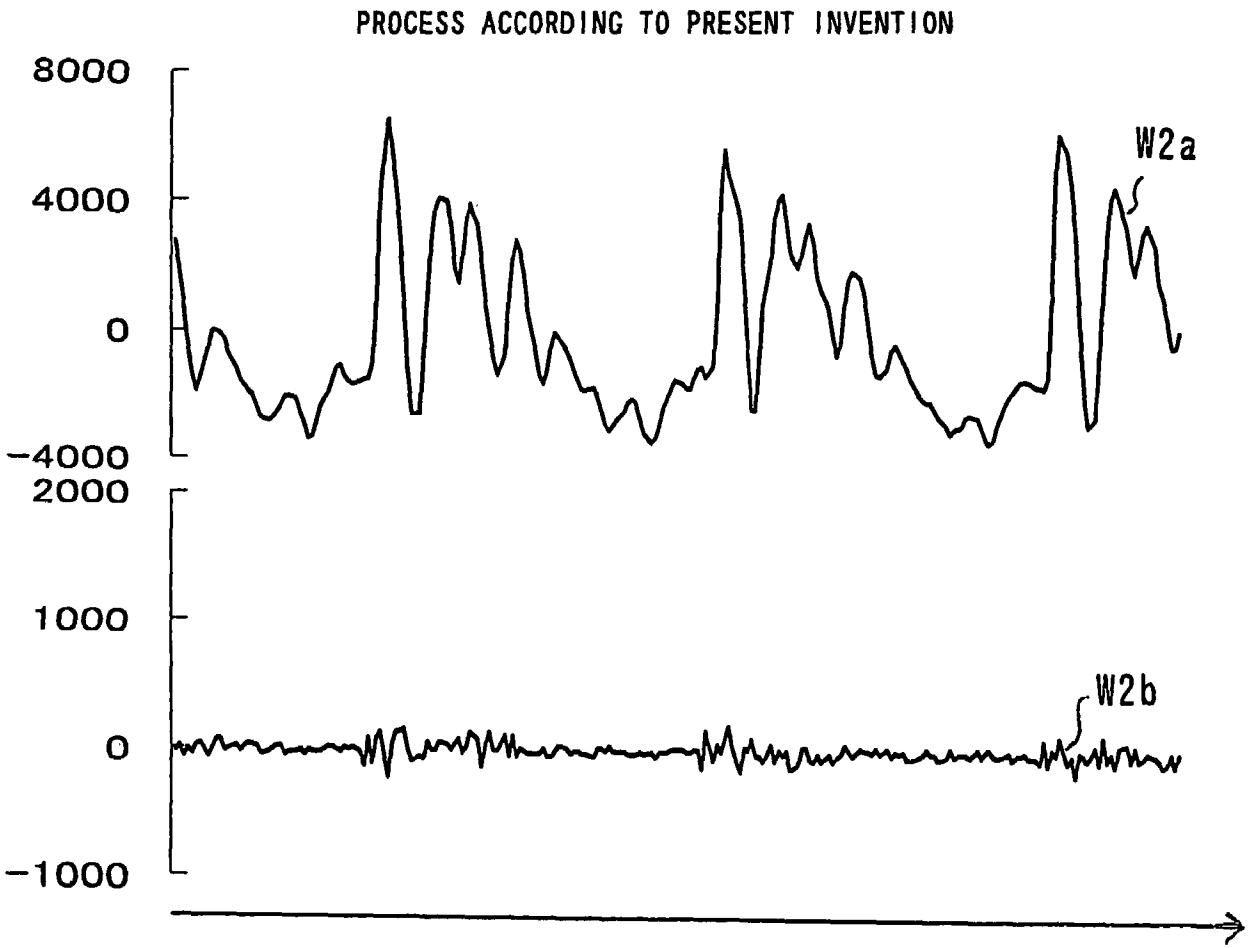
FIG. 15 shows waveforms obtained by performing a process according to the present invention.

The effect of the present invention will now be described. FIG. 14 shows waveforms obtained by performing the conventional process. FIG. 15 shows waveforms obtained by performing the process according to the present invention. In each of FIGS. 14 and 15, a vertical axis indicates amplitude and a horizontal axis indicates time. These waveforms were obtained by making measurement by the use of a file which contains male and female voices.

In FIG. 14, the upper waveform W1*a* is a signal (outputted from an ADPCM decoder) obtained by reproducing a signal encoded by a conventional ADPCM coder and the lower waveform W1*b* is the differential in level between the original input voices and the waveform W1*a*. In FIG. 15, the upper waveform W2*a* is a signal (outputted from the ADPCM decoder) obtained by reproducing a signal encoded by the audio coder 10 according to the present invention and the lower waveform W2*b* is the differential in level between the original input voices and the waveform W2*a* (an error signal indicative of the differential in level is magnified four times).

When the waveforms W1*b* and W2*b* are compared, the waveform W2*b* obtained by applying the present invention is flatter than the waveform W1*b*. That is to say, a quantization error reduces by applying the present invention. An S/N ratio obtained by performing the conventional process was 28.37 dB, but an S/N ratio obtained by performing the process according to the present invention was 34.50 dB. That is to say, an S/N ratio is improved by 6.13 dB. This means that the present invention is effective.

Figure 16:
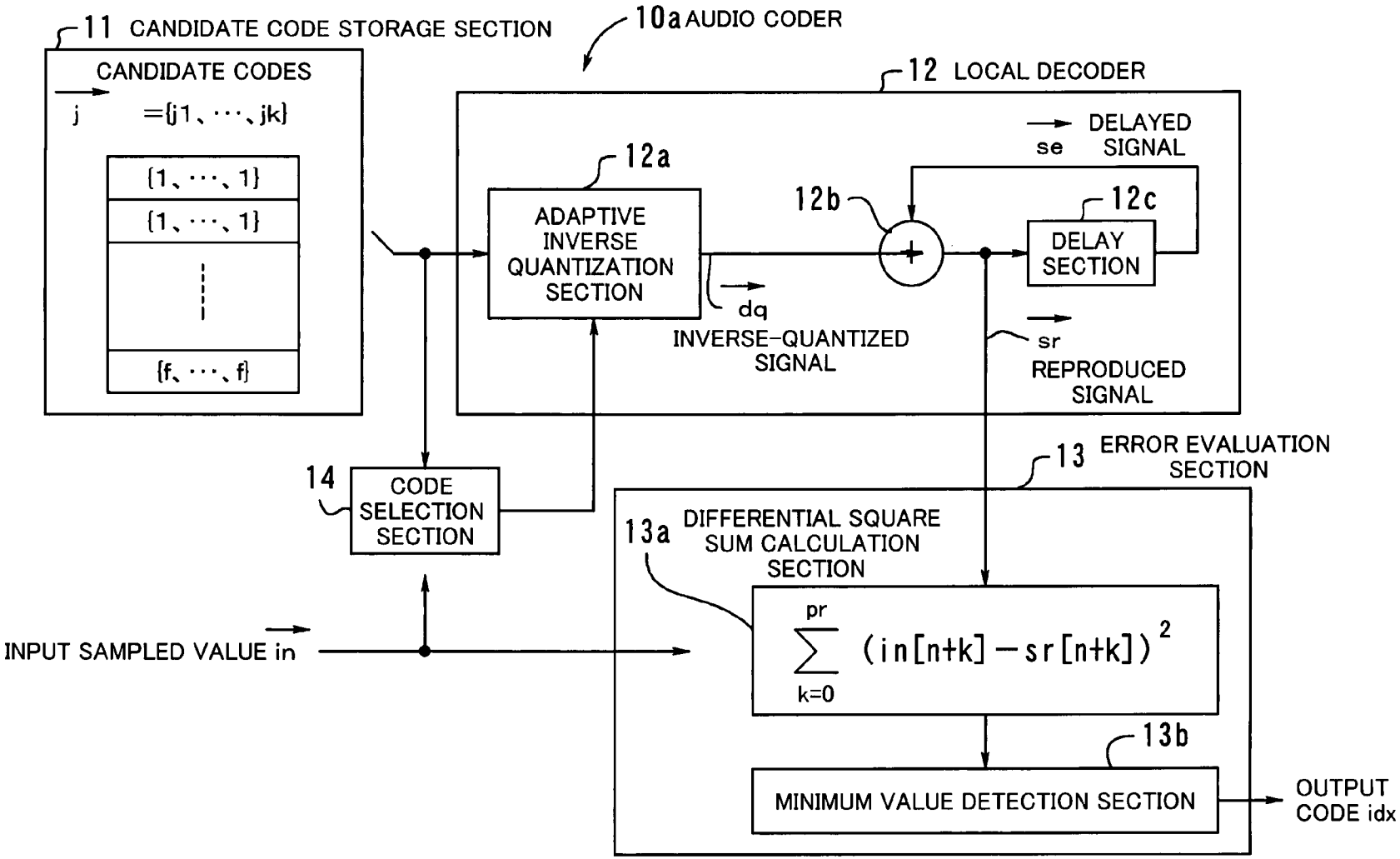
FIG. 16 shows a modification of the present invention.

A modification of the present invention will now be described. FIG. 16 shows a modification of the present invention. An audio coder 10*a* further includes a code selection section 14. The other components of the audio coder 10*a* are the same as those shown in FIG. 12.

It is assumed that the last sampling time in a neighborhood interval is time (n+k). The code selection section 14 selects a code indicative of a value that is the closest to an input sampled value in [n+k] as a candidate code at time (n+k) and outputs it to an adaptive inverse quantization section 12*a*. A local decoder 12 reproduces only a code selected by the code selection section 14 to generate a reproduced signal at time (n+k).

Figure 17:
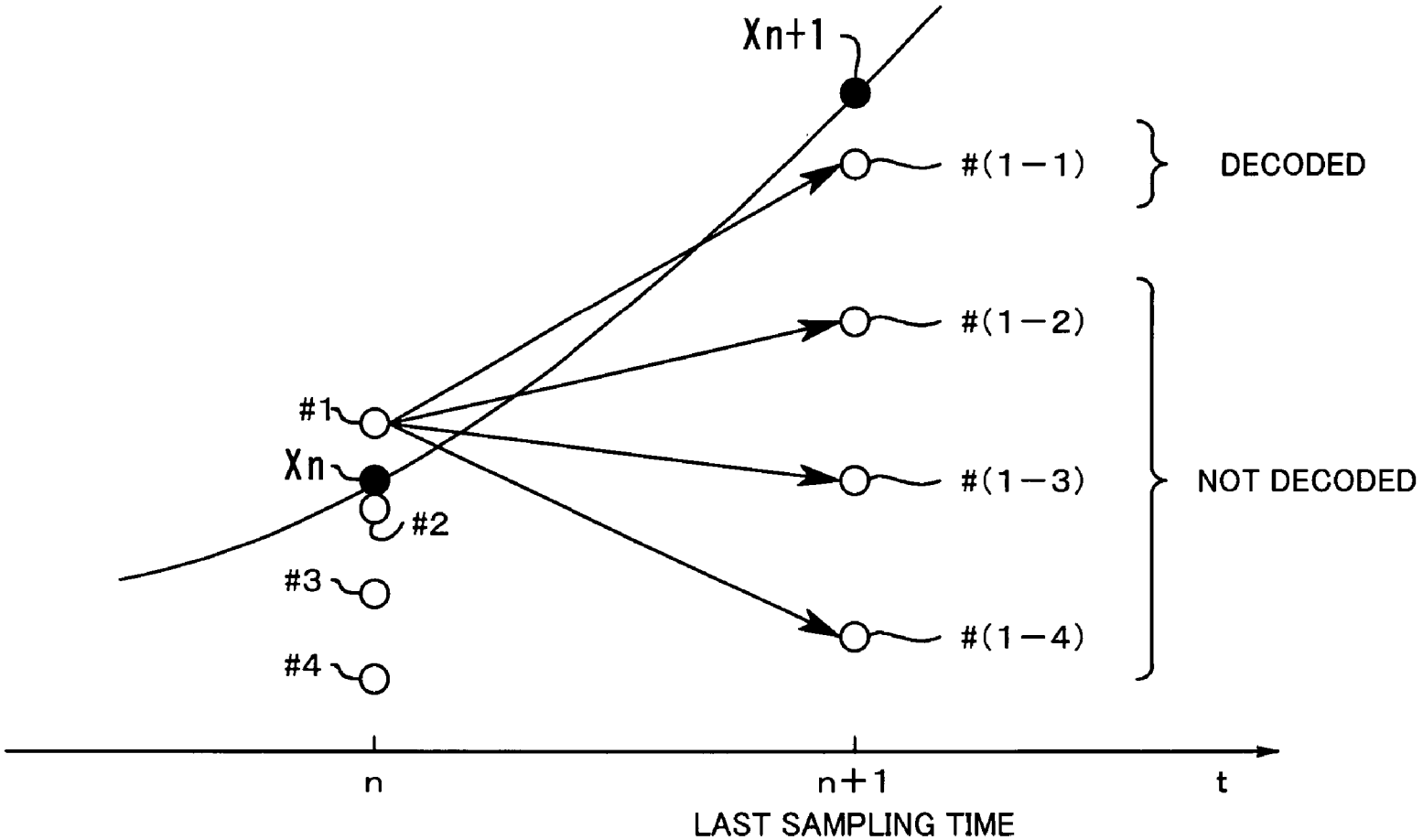
FIG. 17 is a view for describing the operation of the modification.
Figure 18:
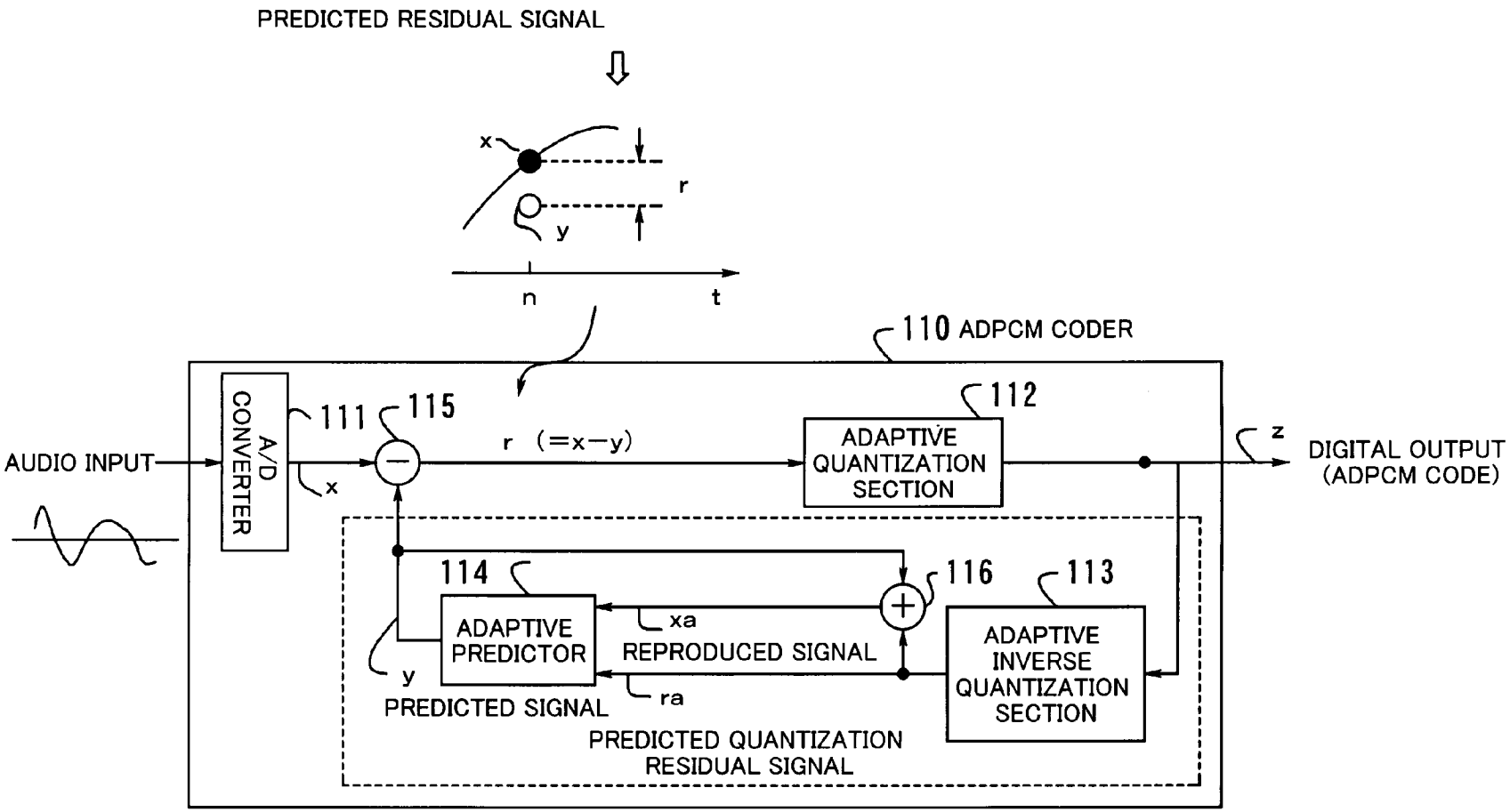
FIG. 18 shows the structure of a block included in an ADPCM coder-decoder.
Figure 19:
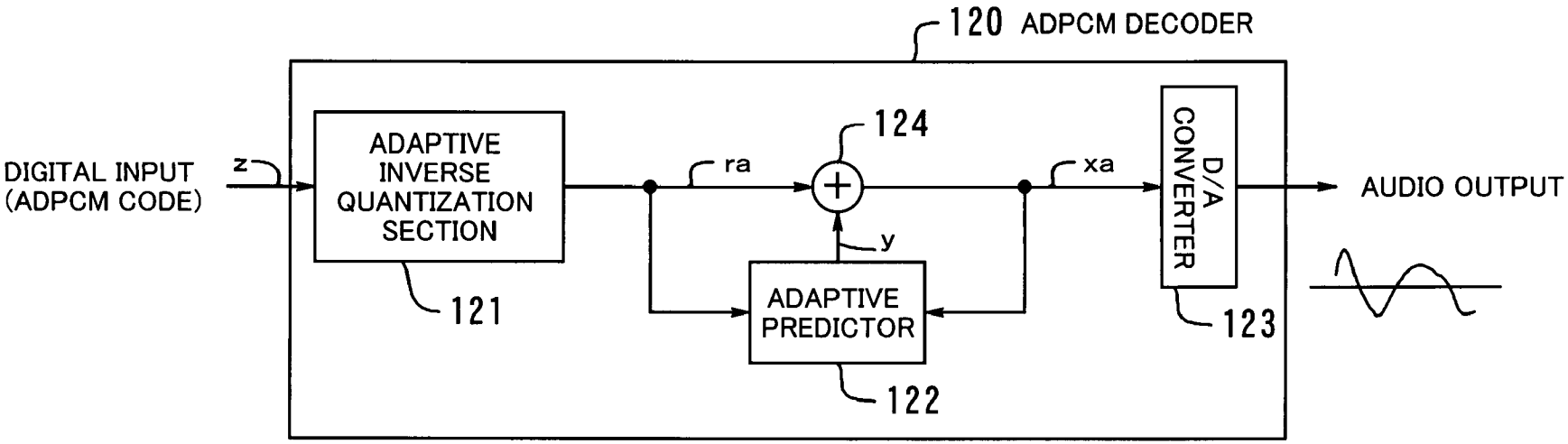
FIG. 19 shows the structure of a block included in the ADPCM coder-decoder.

FIG. 17 is a view for describing the operation of the modification. It is assumed that a code at time n is determined. If the number of future samples is one, then the last sampling time in a neighborhood interval is time (n+1) (if the number of future samples is two, then the last sampling time in a neighborhood interval is time (n+2)).

In the operation in the present invention shown in FIGS. 1 through 15, all of the codes that are inputted from the candidate code storage section 11 are decoded, reproduced signals are generated, and errors are evaluated. In the modification, on the other hand, one code that is the closest to the input sampled value in[n+k] at the last sampling time (n+k) is selected in advance as a candidate code at the last sampling time (n+k) by the code selection section 14 (ordinary coding is performed). At the last sampling time (n+k), only the code is decoded by the local decoder 12, a reproduced signal is generated, and an error is evaluated by an error evaluation section 13.

In FIG. 17, #(1-1) is selected by the code selection section 14. Accordingly, only #(1-1) is decoded by the local decoder 12 and #(1-2) through #(1-4) are not decoded. This reduces the number of calculations and processing speed can be improved.

In the present invention, as stated above, when a code is selected, not only the current sample but also a quantization error in the neighborhood sampling interval is taken into consideration. This reduces a quantization error and audio quality can be improved. The above descriptions have been given with the case where an audio signal is coded as an example. However, the present invention is not limited to such a case and can be applied to various fields as one of low bit rate coding methods.

With the audio coder according to the present invention, as has been described in the foregoing, when a code corresponding to a sampled value of an audio signal is determined, all of combinations of candidate codes in a neighborhood interval of the sampled value are stored, the stored codes are decoded to generate reproduced signals, sums of squares of differentials between input sampled values and reproduced signals are calculated, a combination of candidate codes by which a smallest sum is obtained is considered as what minimizes a quantization error, and a code included in the combination of candidate codes is outputted. As a result, even if there is a great change in the amplitude of the audio, a quantization error can be reduced efficiently and audio quality can be improved.

The foregoing is considered as illustrative only of the principles of the present invention. Further, since numerous modifications and changes will readily occur to those skilled in the art, it is not desired to limit the invention to the exact construction and applications shown and described, and accordingly, all suitable modifications and equivalents may be regarded as falling within the scope of the invention in the appended claims and their equivalents.

What is claimed is:

1. An audio coder for coding an audio signal, the coder comprising:

a candidate code storage section for storing, at the time of determining a code corresponding to a sampled value of the audio signal, a plurality of combinations of candidate codes in a neighborhood interval of the sampled value;

a decoded signal generation section for generating reproduced signals by decoding the codes stored in the candidate code storage section; and an error evaluation section for calculating, for each candidate code, a sum of squares of differentials between input sampled values and reproduced signals, detecting a combination of candidate codes by which a smallest sum is obtained, that is to say, which minimizes a quantization error, and outputting a code included in the detected combination of candidate codes.

2. The audio coder according to claim 1, wherein when a code corresponding to a sampled value at time n is determined and if time (n+k) is set with pr future samples as a neighborhood interval ($0 \leqq k \leqq pr$):

the candidate code storage section stores a plurality of combinations of candidate codes J{j1, j2 , . . . , jk, j(k+1)} which correspond to sampled values at time n through (n+k) respectively;

the decoded signal generation section generates reproduced signals sr(J) in order from the codes j1, j2, . . . , jk, and j(k+1); and the error evaluation section detects a combination of candidate codes {j1, j2, . . . , jk, j(k+1)} which minimizes error evaluation value e(J) given by $$e(J) = \sum_{k=0}^{pr} (in[n+k] - sr[n+k])^2$$

and outputs the code j1 included in the detected combination of candidate codes {j1, j2, . . . , jk, j(k+1)} as the code at time n, where in is an input sampled value and $0 \leqq k \leqq pr$.

3. The audio coder according to claim 1, further comprising, at the time of determining a code corresponding to a sampled value at time n, a code selection section for selecting a code the closest to an input sampled value in[n+k] at time (n+k) which is last sampling time in a neighborhood interval including pr future samples (k=pr), wherein the decoded signal generation section reproduces only the code selected by the code selection section to generate a reproduced signal at the last sampling time (n+k).

4. A method for coding a signal, the method comprising, at the time of determining a code corresponding to a sampled value at time n and in the case of time (n+k) being set with pr future samples as a neighborhood interval ($0 \leqq k \leqq pr$), the steps of:

storing a plurality of combinations of candidate codes J{j1, j2, . . . , jk, j(k+1)} which correspond to sampled values at time n through (n+k) respectively;

generating reproduced signals sr(J) in order from the codes j1, j2, . . . , jk, and j(k+1); and detecting a combination of candidate codes {j1, j2, . . . , jk, j(k+1)} which minimizes error evaluation value e(J) given by $$e(J) = \sum_{k=0}^{pr} (in[n+k] - sr[n+k])^2$$

and outputting the code j1 included in the detected combination of candidate codes {j1, j2, . . . , jk, j(k+1)} as the code at time n, where in is an input sampled value and $0 \leqq k \leqq pr$.

5. The method according to claim 4, further comprising, at the time of determining the code corresponding to the sampled value at time n, the steps of:

selecting a code the closest to an input sampled value in[n+k] at time (n+k) which is last sampling time in a neighborhood interval including pr future samples (k=pr); and reproducing only the code selected to generate a reproduced signal at the last sampling time (n+k).

* * * * *